United States Patent [19]

Krack

[11] 4,186,834

[45] Feb. 5, 1980

[54] SHIPPING AND STORAGE CONTAINER

[75] Inventor: George W. Krack, Evansville, Ind.

[73] Assignee: Inland Container Corporation, Indianapolis, Ind.

[21] Appl. No.: 941,056

[22] Filed: Sep. 11, 1978

[51] Int. Cl.[2] ..... B65D 85/54; B65D 85/64

[52] U.S. Cl. ..... 206/320; 229/23 R; 220/416

[58] Field of Search ..... 206/320, 407, 326, 413, 206/491; 220/416, 415, 468; 229/23 R

[56] References Cited

U.S. PATENT DOCUMENTS

| | | | |
|---|---|---|---|
| 3,680,688 | 8/1972 | Smith | 206/320 |
| 3,757,935 | 9/1973 | Coons | 206/320 |
| 3,773,171 | 11/1973 | Edsall | 206/320 |
| 3,797,653 | 3/1974 | Goodsite | 206/320 |
| 3,845,859 | 11/1974 | Darnbush | 206/320 |
| 3,900,101 | 8/1975 | Goodsite | 206/320 |
| 3,957,158 | 5/1976 | Poggiali | 206/320 |
| 3,999,658 | 12/1976 | Anderson | 206/320 |

*Primary Examiner*—Herbert F. Ross

*Attorney, Agent, or Firm*—Fitch, Even & Tabin

[57] ABSTRACT

A shipping and storage container for an elongated article, such as a bathtub, includes a pair of end caps each formed of a single precut sheet and having an integral lower cushion member, an outer wall and an inner wall. A formed portion of the inner wall defines a hollow vertical support. An outer wrapper of foldable fiberboard material extends around the article and at least the peripheries of the caps and is secured to the caps to enclose and protect the article when a package is formed.

18 Claims, 8 Drawing Figures

30
36
22
32
24
26
82
66
12
62
64
65
63
28
34

30
36
88
96
94
74
26
58
22
68
84
80
60
76
78
66
70
82
86
92
90
72
73
38
40
42
44
46
54
52
50
56
48
34
20
12
64
65
62
63
28
24

120
110
14
118
117
112
118
116
114
12
24
102
10
24
100
108
98
108
16
104
106

26
10
106
102
14
117
16
120
12
26
108
90
64
64
90
30
32
32
30
34
22
112
112
22
34
114
24
98
24
114

SHIPPING AND STORAGE CONTAINER

This invention relates generally to paperboard containers and more particularly to a shipping and storage container for an elongated article, such as a bathtub, to provide resistance to damage during shipping and protection during storage of similar packed articles stacked on top of each other.

Elongated articles, such as residential bathtubs, may present significant problems of handling during shipping and storage because of their large size, weight, irregular shape and porcelain finished surfaces. A shipping and storage container for such elongated articles, therefore, must be of substantial strength to adequately protect the article. A marred surface is unattractive and diminishes the value of the article. Because porcelain surfaces can be damaged during handling of the article, it is important that the containers have provision for supporting the packed article in a manner that will not subject its surfaces to marring of any kind. It is desirable that the container be as light in weight as possible consistent with the strength needed to adequately protect the article. Corrugated fiberboard of double wall construction has cost and other advantages which justify its use for containers of this type, and improved container designs are desired.

Tubular containers with end caps for packaging and protecting bathtubs are shown in U.S. Pat. Nos. 3,957,158 and 4,008,844. The packages shown and described in these patents utilize a five-part container that includes a pair of two-part end caps. An independent multi-panel blank is folded separately to form a thick member which must be attached and locked in place on each end cap wall. This added number provides end support for both the bathtub and the package, but covers only part of the inner surface of the end cap wall. Thus, there are at least four thicknesses of sheet material added to the part of each end cap wall where these separate vertical support members are folded and locked in place, but there is no provision for adding extra thickness to most of the remaining part of the end cap walls. The separate blanks that must be folded to complete the end caps in this design adds to the cost of the package both in material cost and labor time. The convenience of forming the package is also impaired by the handling of the separate pieces and the forming of them into an end cap structure. Further, even the two-piece design of the end caps does not provide more than a single wall thickness of protection for the end flanges of the bathtubs of the completed package.

It is an object of this invention to provide an improved shipping and storage container for an elongated article, such as a bathtub, that has high strength characteristics and is low in cost and easy to assemble.

It is another object of this invention to provide a shipping and storage container for an elongated article, such as a bathtub, that may be made of corrugated fiberboard and that provides superior protection for the article when packed therein.

Other objects of the invention will become apparent to those skilled in the art from the following description, taken in connection with the accompanying drawings wherein.

Figure 3:
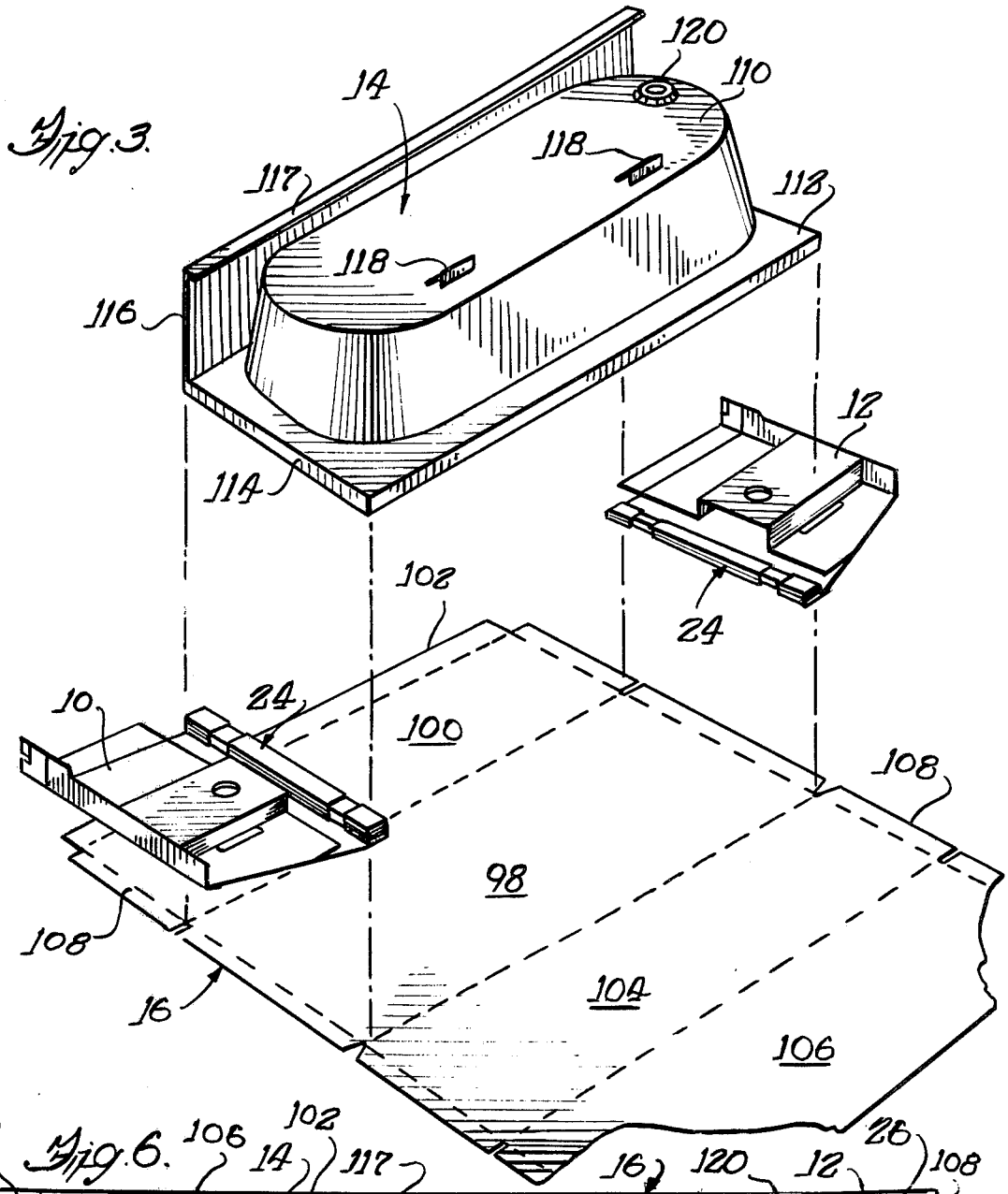
FIG. 3 is an exploded perspective view illustrating the packaging of the article.
Figure 4:
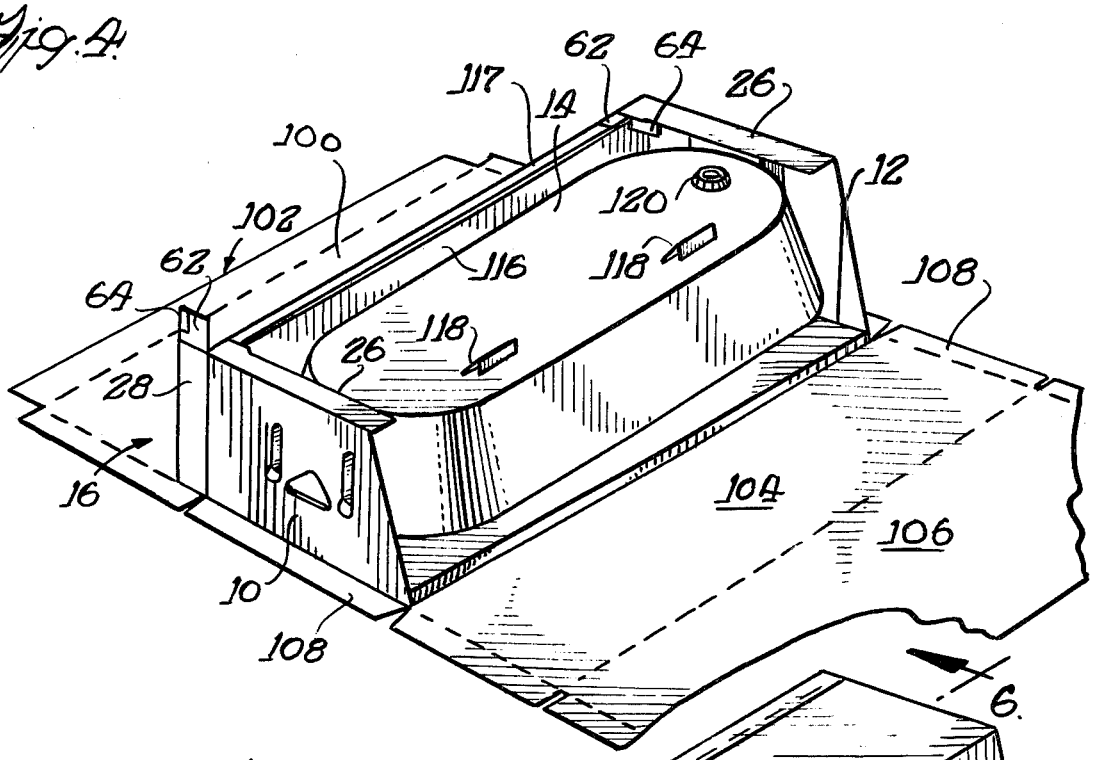
FIG. 4 is a perspective view of the package partly formed and illustrating both end caps folded up with the right end cap locked in position and the left end cap ready to be locked in position.
Figure 5:
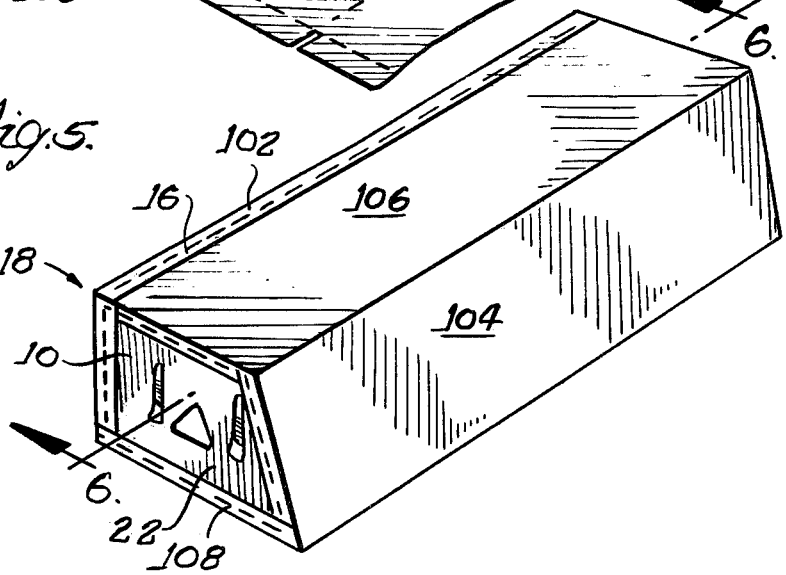
FIG. 5 is a perspective view of the shipping and storage container of the invention in assembled condition.

Very generally, and as best seen in FIGS. 3 and 4, the shipping and storage container of the invention comprises a pair of end caps 10 and 12 each adapted to be disposed in surrounding relation to a respective end portion of an article 14 that is to be packaged. An outer wrapper 16 of foldable rigid material extends around the article and at least the peripheries of the end caps and is secured to the end caps to provide a complete package 18 (FIG. 5).

Figure 2:
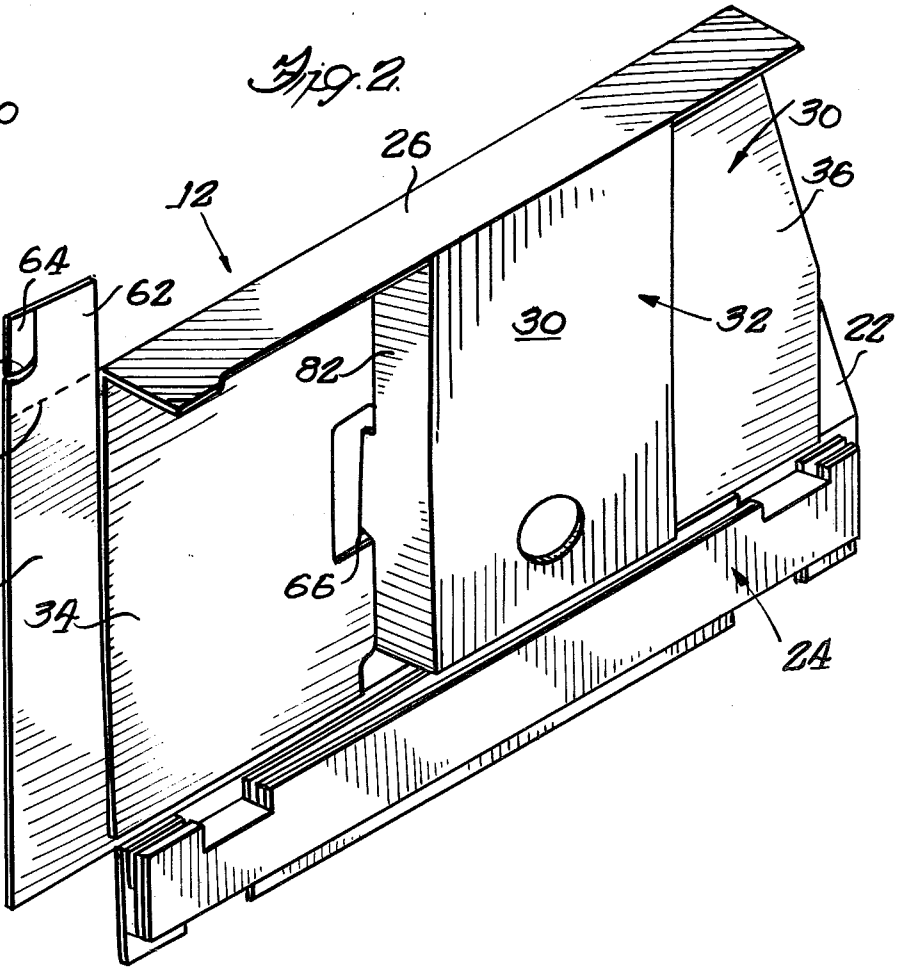
FIG. 2 is a perspective view illustrating the blank of FIG. 1 partly folded into an end cap.
Figure 1:
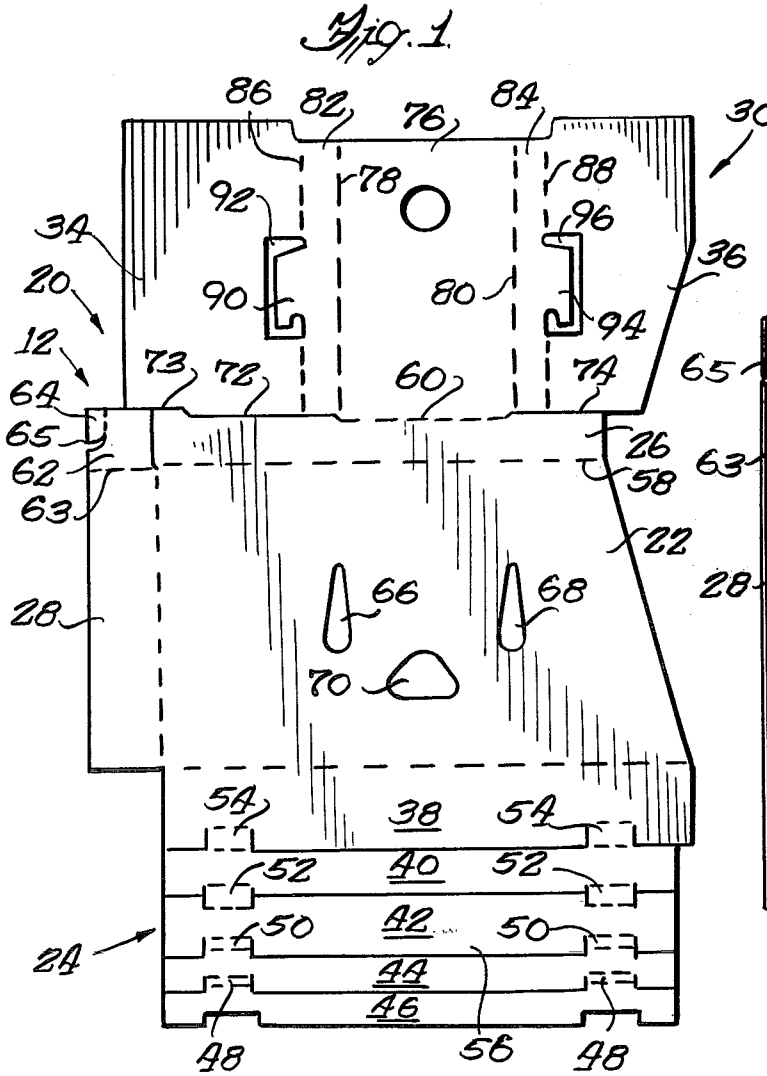
FIG. 1 is a plan view illustrating a fiberboard blank from which an end cap of the container of the invention is constructed.

Referring now to FIGS. 1 and 2, briefly each end cap is formed from a single precut blank 20 by folding portions of it generally to the form illustrated in FIG. 2. From this single precut sheet 20 is formed an outer end wall 22, a cushion 24 hingedly connected along the lower edge of the outer wall 22, and upper ledge 26 hingedly connected along the upper edge of the outer wall 22 and end panel 28 hingedly connected along a vertical edge of the end wall 22, and an inner wall 30 hingedly attached along the free edge of the ledge 26 and folded to a position generally adjacent the inner surface of the outer end wall 22. When folded, the inner end wall 30 includes a portion spaced inwardly from the outward wall 22 to define a hollow vertical support member 32 having laterally extending wings 34 and 36 hingedly connected on either side of the vertical support member and lying parallel to and immediately adjacent the inner surface of the outer end wall 22. The vertical support member extends generally between the completed cushion and the upper ledge to provide support between these two members for the ends of the container and the article packed in the container, especially when similarly packed containers are stacked on top of each other. The wings extend generally between the underside of the ledge and the lower edge of the outer wall to provide additional end wall thickness and additional vertical support for the ends of the container.

More particularly, with reference to FIG. 1 and the details of the end cap 12, the end cap 12 is formed of a unitary piece of a foldable rigid material, such as corrugated double wall fiberboard. The blank 20 from which the end cap 12 is made is die cut and scored so that it may be stored in the flat until needed for forming a package. The end cap 10 is a mirror image of the end cap 12, and to simplify the description is not shown in detail. The die cutting of the end caps is the same. The primary difference between the two is the face on which scoring is made for enhancing the direction of folding.

The end cap 12 includes a central panel 22 of trapezoidal shape, which in the formed end cap becomes the generally four-sided planar outer end wall 22. Along the longest edge of the panel 22 are five inter-connected minor panels 38, 40, 42, 44 and 46 hinged along the panel 38 to the panel 22. The flat blank 20 is scored as shown by dotted lines and cut to provide hinges 48 between the panels 44 and 46, hinges 50 between the panels 42 and 44, hinges 52 between the panels 40 and 42, and hinges 54 between the panels 38 and 40. The hinges 48, 50, 52 and 54 are made of increasing width to accommodate the increasing thickness of the folded over minor panels, which folding is described hereinafter. The formation and location of the hinges 50 provide an extended tab 56 which is discussed hereinafter.

A panel 26 is hinged by a score line 58 along the opposite edge of the central panel 22. This panel 26 becomes the ledge 26 in the folded end cap. A second panel generally designated 30 is connected to the panel 26 by a shorter hinge indicated by a score line 60. Along the straight edge of the panel 22 is the panel 28 hinged thereto by a score line. A flap 62 extends from one end of the panel 28 and is hingedly connected by a score line 63 which is offset from the score line 58 to allow the flap 62 when folded to tuck under the adjacent end of the panel or ledge 26 as described hereinafter. A locking tab 64 having a curved edge 65 is provided in the free corner of the flap 62. The end panel 28, the flap 62, and the tab 64 all cooperate to lock the end cap 12 in position with respect to the article during packaging, as also will be seen hereinafter.

The central panel 20 includes a pair of spaced apart teardrop-shaped slots 66 and 68. The slots are located generally centrally between the top and bottom edges, and their longitudinal axes are parallel to each other and spaced apart by substantially the width of the hollow vertical support 32 (FIG. 2) to receive the locking tabs thereof, as will also be seen in detail hereinafter. A triangular shaped hand hole 70 is provided in the panel 22 midway between and slightly lower than the slots 66 and 68. The lower side of the triangular hole is parallel with the lower edge of the panel 22 to provide a gripping area for handling the package once it is inverted after packaging.

The terms "upper" and "lower" are relative terms and as used herein have reference to the location of the various parts during the forming of the package, as later described in connection with FIGS. 3 and 4, i.e., when the article is upside down. After the package is formed, it may thereafter be inverted, i.e., with the article, such as a bathtub, in its upright position. The bathtub is then carried on the vertical support as will be seen hereinafter. Like packages with this orientation may thereafter be stacked on top of each other.

With continued reference to FIG. 1, as stated previously, the panel generally designated 30 is connected to the central panel 22 through the ledge 26 by the score line 60. Extending from either end of the score line 60 and laterally of the blank 20 are slits 72 on the left and 74 on the right. The slit 72, however, has an offset portion that extends to the outer edge of the blank 20 which provides a notch 73 in the wing 34 to receive the inner edge of the flap 62 when the panel 28 is folded and the flap 62 is tucked under the ledge 62.

Adjacent the score line 60 is a support panel 76 defined on the left side by a score line 78 and on the right side by a score line 80. Hingedly connected at these score lines are side panels 82 and 84 respectively, at the outer edges of which are score lines 86 and 88 hingedly joining the wings 34 and 36 respectively. To the left of the score line 86 is a locking tab 90 formed by means of a die cut 92 in the wing 34 in combination with the score line 86. It will be noted that the score line 86 does not enter the body of the tab 90 but stops at the ends of the die cut. Thus, the tab 90 will remain in the same plane as the side panel 82 to which it is connected when folds are made along the score lines 78 and 86 to form its vertical support member 32 having the side wings 34 and 36.

A mirror image of this structure exists on the right side. Thus, there is a locking tab 94 formed by means of a die cut 96 in the wing 36 to the right of the score line 88. The score line 88 likewise does not extend beyond the ends of the die cut 96 into the body of the locking tab 94. Hence, the locking tab 94 will remain in the same plane as the side panel 84 to which it is connected when folds are made along the score lines 80 and 88 to form the vertical support member 32.

In assembling the end cap 12, the cushion 24 is formed by folding the panel 46 over the panel 44, and then folding the panels 44 and 46 over to lie against the panel 42 with the panel 46 being sandwiched between the panel 42 and the panel 44. The panels 42, 44 and 46 are then folded over onto the panel 40 so that the panel 44 lies against the panel 40. The panels 40, 42, 44 and 46 are then folded over the hinges 54 onto the panel 38 so that the panel 42 lies against the panel 38. In doing this, the tab 56 is inserted through the space between the hinges 54 and wedges itself against the adjacent portion of the panel 38 to secure the folded-over assembly in place. At this point, the folded-over assembly appears as the cushion 24 in FIG. 2 and lies generally in the same plane as the inner wall 22. In this illustrated embodiment, the cushion is thus formed into a five layer stack of juxtaposed panels.

The wing 34 and side panel 82 as one unit and the wing 36 and side panel 84 as another unit are then folded upwardly along the score lines 78 and 80 respectively to form right angles at the score lines. The wings 34 and 36 are then folded at right angles outwardly along the score lines 86 and 88 respectively causing these wings to be in the same plane parallel to and spaced apart from the plane of the panel 76. The locking tabs 90 and 94 at this point extend at right angles to these two planes and away from the panel 76.

The whole inner wall assembly 30 is then folded upwardly to form a right angle along the score line 58 between the inner wall 30 and the center panel 22. The inner wall 30 is then folded along the score line 60 to bring the wings 34 and 36 in face-to-face relation with the panel 22. The projecting locking tabs 90 and 94 are inserted through the teardrop-shaped receiving slots 66 and 68 respectively and their lower hook portions lock the inner wall 30 into position against the inner surface of the outer wall 22. At this point the configuration is in the form depicted in FIG. 2, and the hollow support member 32 has the preferred rectangular cross-sectional form there shown. The flutes of the fiberboard are oriented such that they run vertically in all vertical surfaces of this formed end cap, and this structure provides strong vertical support.

The order in which the folding of the various parts of the end cap 12 is accomplished is described by way of example only and is not intended to be limited to the particular sequence given. An assembler may find it convenient to vary the sequence when folding the parts, and this may be done within the purview of the invention. An end cap 10 is thereafter similarly assembled, and then the assembly of the entire package is ready to proceed.

Referring now more particularly to FIG. 3, the outer wrapper 16 is made from a suitable blank of a foldable, relatively rigid material, such as corrugated single wall fiberboard. The wrapper is scored to fit snugly around the contour of the end caps 10 and 12, as shown in FIG. 5. The outer wrapper includes a bottom panel 98 with a first side panel 100 hingedly connected thereto. A securing flap 102 is carried by the free edge of the panel 100. A second side panel 104 is connected to the opposite longitudinal edge of the panel 98 and is, in turn, hinged to a top panel 106. The end edges of the outer wrapper 16 are provided with glue flaps 108. The flutes of the corrugations run longitudinally of the individual panels, i.e., parallel to the dotted score lines in FIG. 3 that define the panels 98–106.

The article 14 for purposes of this description is represented by a bathtub. It should be understood, however, that the principles of this invention are not limited to elongated articles that are only bathtubs. The illustrated bathtub comprises a tub portion 110 of the usual contour which is illustrated in the upside down position while the package is assembled. A horizontal flange or shelf 112, which is basically of rectangular outline, surrounds the tub opening, and a vertical flange 114 is disposed at right angles to the horizontal flange 112 and serves as a lip around three sides of the horizontal shelf 112, the three sides consisting of the two ends and one of the long sides. A vertical wall or skirt 116 serves as the front wall of the tub. The free horizontal edge of the skirt 116 may include a flange or foot 117, which along with a pair of spaced rear legs 118 support the tub on a floor. The legs 118 are illustrated as metal angles welded to the bottom of the tub. The tub also is provided with a suitable drain connection 120.

Figure 8:
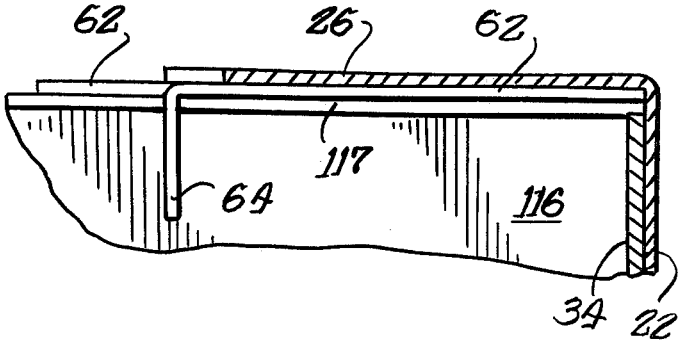
FIG. 8 is a fragmentary sectional view taken in a plane extending through the line 8—8 of FIG. 7 and illustrating the relationship between a locking tab of the end cap and a surface of the packaged article.
Figure 7:
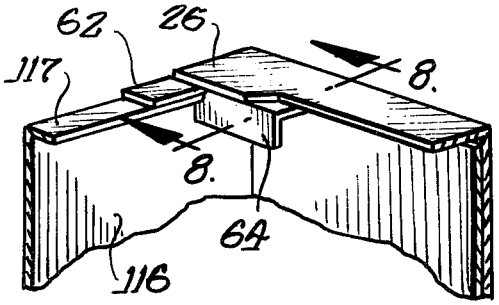
FIG. 7 is a fragmentary perspective view of the upper right corner of the partially completed package as viewed in FIG. 4.

In assembling the package, the outer wrapper 16 is spread upon a floor or platform in the manner shown in FIG. 3. The end caps 10 and 12 are folded to the partially assembled condition previously described and shown in FIG. 2 and are each placed such that the cushions 24 are positioned upon the end margins of the bottom panel 98 just inwardly of the glue flaps 108. The bathtub is then placed on the bottom panel 98 so that the flange 112 rests on the top of the cushions 24 with the end portions of the vertical flange or lip 114 locking over the outer edges. Once the tub is so positioned, the end caps are folded upwardly along the score lines between the panels 22 and 38 (FIG. 1) until they fit snugly in surrounding relation to the ends of the tub and the lower edge 117 of the skirt 116 as seen in FIG. 4. The end caps are locked in position by the folding of the end panels 28 in against the front surface of the skirt 116. At the same time this fold is being made, the flap 62 is folded and tucked under the adjacent end of the upper ledge 26. The offset dispositions of the score lines 63 and 58 and the offset slit 72 (FIG. 1) provide clearance for the flap 62 in this folded position. The locking tab 64 is then folded inwardly of the package and its curved edge 65 locks under the ledge or foot 117 of the tub to hold the end caps 10 and 12 in position at least until the next phase of packaging is completed and the wrapper is folded secured to the end caps. Details of this locking structure are shown in FIGS. 7 and 8.

The panel 104 of the outer wrapper 16 is then folded upwardly against the slanting exposed edges of the outer walls 22 of the end caps, and the top panel 106 is folded down across the tub into a horizontal position. To complete the shipping package, the panel 100 is folded to a vertical disposition along the vertical front wall or skirt 116 of the tub, and the securing flap 102 is folded downwardly to overlap the panel 106. This flap 102 is secured to the panel 106 in a suitable manner, such as by stapling, stitching or glueing. The end flaps 108 are then folded in against their respective adjacent outer margins of the walls 22 and secured in a similar manner to complete the package as shown in FIG. 5.

Figure 6:
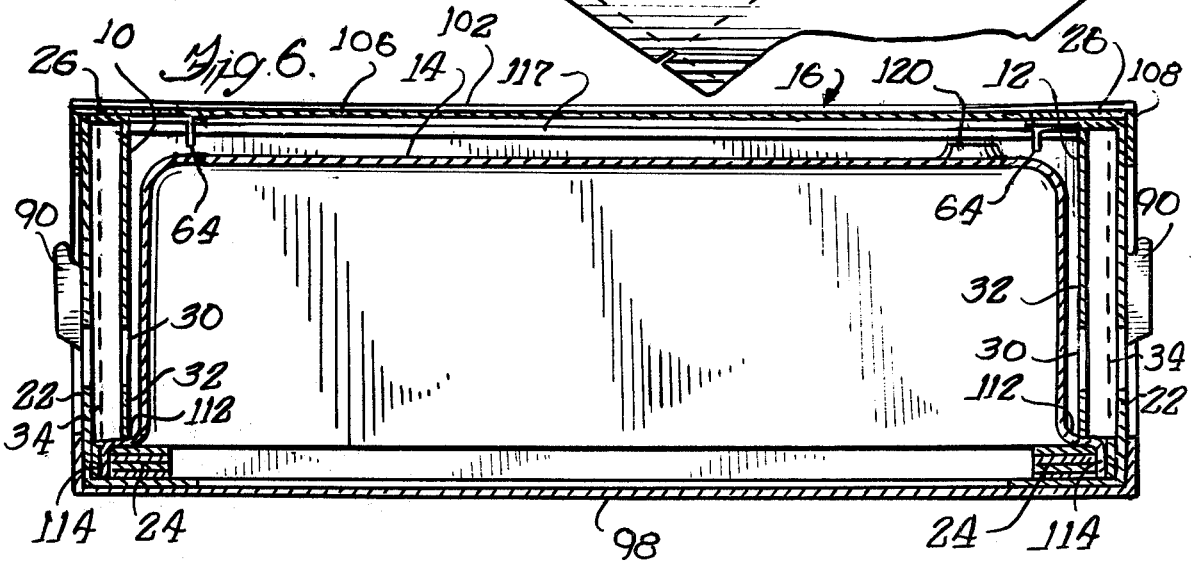
FIG. 6 is a sectional view taken in a plane extending through the line 6—6 of FIG. 5 and showing the assembled container with the article packaged therein.

A special feature of this package is the protective manner by which the container structure carries the bathtub. Referring now to FIGS. 5 and 6, it will be seen that the vertical ledge or lip 114 is sandwiched between the outer vertical edge of the cushion 24 and portions of the inner surfaces of the inner wall 30 at both ends of the package. Further, the lower edges of the hollow vertical support members 32 lock the horizontal flange or shelf 112 to the cushions 24. Thus, when the package is inverted, as for shipping, the tub will be securely held in position within the package. This construction allows like packages to be stacked on top of each other and the ends of the containers and the articles within the containers are supported by the end caps of the packages thru the integral vertical support members 32 and the wings 34 and 36. In this connection, the wings 34 and 36 add vertical support to the ends of the package as well as additional wall thickness. It will be noted that the flange 114 of the tub is the beneficiary of this additional wall thickness.

The invention thus provides an improved shipping and storage container for forming a package of an elongated article. More particularly, it provides an improved container for a bathtub package which may be economically constructed of single wall and double wall corrugated fiberboard and economically assembled for packaging. The container provides high strength and a high degree of protection for the packaged article while being readily manufactured and assembled.

Accordingly, the invention provides a shipping and storage container for an elongated article that includes a pair of end caps for disposition in surrounding relation to the end portions of the article. Each end cap is formed from a single precut sheet and includes a generally planar outer end wall, a cushion member hingedly attached along the lower edge of the outer end wall and positioned to extend inwardly and generally normal to the end wall, a ledge hingedly attached along the upper edge of the outer end wall and extending inwardly and generally normal to the end wall, the ledge serving as a support surface when stacking similar containers, and an inner end wall hingedly attached along the free edge of the ledge and folded to a position generally adjacent the inner surface of the outer end wall. The inner end wall includes a portion spaced inwardly from the outer wall and wing portions on either side of the spaced portion that are located immediately adjacent the outer wall. The spaced portion defines a hollow vertical support member and extends generally between the cushion and the ledge and provides support therebetween for the article and the ends of the container when the article is packed in the container and when similarly packed containers are stacked on each other. The wing portions extend generally between the underside of the ledge and the lower edge of the outer wall and provide additional end wall thickness and additional vertical support for the ends of the container. The container also includes an outer wrapper of foldable material that extends around the article and at least the peripheries of the end caps and is secured to the end caps to completely enclose the article when packed in the container.

Various modifications of the invention will become apparent to those skilled in the art from the foregoing description and accompanying drawings. Such modifications are intended to fall within the scope of the appended claims.

What is claimed is:

1. A shipping and storage container for an elongated article, comprising:

a pair of end caps for disposition in surrounding relation to the end portions of the article, each said end cap being unitary and from a single precut sheet and including a generally planar outer end wall, a cushion member hingedly attached along the lower edge of said outer end wall and positioned to extend inwardly and generally normal thereto, a ledge hingedly attached along the upper edge of said outer end wall and extending inwardly and generally normal thereto, said ledge serving as a support surface when stacking similar containers, and an inner end wall hingedly attached along its upper edge to said ledge and folded to a position generally adjacent the inner surface of said outer end wall, said inner end wall including a portion spaced inwardly from said outer wall and wing portions on either side thereof located immediately adjacent said outer wall, said spaced portion defining a hollow vertical support member and extending generally between said cushion and said ledge and providing support therebetween for the article and the ends of said container when the article is packed in said container and when similarly packed containers are stacked on each other, and said wing portions extending generally between the underside of said ledge and the lower edge of said outer wall and providing additional end wall thickness and additional vertical support for the ends of said container;

and an outer wrapper of foldable material extending around the article and at least the peripheries of said end caps and secured to said end caps to completely enclose said article when packed in said container.

2. A container in accordance with claim 1 wherein the article is a bathtub having a depending front skirt on one of its longitudinal sides and the generally planar outer end wall is in the form of a trapezoid.

3. A container in accordance with claim 2 wherein said outer end wall includes a hingedly connected end panel having at its upper end a foldable flap and the flap in turn having a foldable tab, all of which are foldable down over the front skirt of the bathtub to hold the end cap in place during packaging of the bathtub.

4. A container in accordance with claim 1 wherein said cushion member is formed from a plurality of laterally hinged panels folded into a stack of juxtaposed panels.

5. A container in accordance with claim 1 wherein said single precut sheet forming said end cap is made of corrugated double wall fiberboard material with the flutes of the fiberboard running vertically in all vertical surfaces of the formed end cap.

6. A container in accordance with claim 1 wherein said portion of said inner wall defining said hollow vertical support member includes a plurality of laterally hinged panels folded in angularly disposed relation to a rectangular cross-sectional form.

7. A container in accordance with claim 1 wherein said outer end wall of said end cap includes two spaced apart, substantially parallel slots and said inner end wall includes a pair of integrally formed locking tabs that project in the direction of the outer wall when the inner wall is formed and folded against the inner surface of the outer wall and extend through said slots and lock the folded inner wall in position inwardly adjacent the outer wall.

8. In a shipping and storage container for an elongated article, a pair of end caps for disposition in surrounding relation to the end portions of the article, each said end cap being unitary and formed from a single precut sheet and comprising a generally planar outer end wall, a cushion member hingedly attached along the lower edge of said outer end wall and capable of being positioned to extend inwardly and generally normal thereto, a ledge hingedly attached along the upper edge of said outer end wall and extending inwardly and generally normal thereto, said ledge serving as a support surface when stacking similar containers, and an inner end wall hingedly attached along its upper edge to said ledge and folded to a position generally adjacent the inner surface of said outer end wall, said inner end wall including a portion spaced inwardly from said outer end wall and wing portions on either side thereof located immediately adjacent said outer wall, said spaced portion defining a hollow vertical support member and extending generally between said cushion and said ledge to provide support therebetween for the article and the ends of said container when the article is packed in said container and when similarly packed containers are stacked upon each other, and said wing portions extending generally between the underside of said ledge and the lower edge of said outer wall to provide additional end wall thickness and additional vertical support for the ends of said container.

9. An end cap in accordance with claim 8 wherein said single precut sheet is made from corrugated double wall fiberboard material with the flutes of the fiberboard running vertically on all vertical surfaces when the end cap is folded into its final form.

10. An end cap in accordance with claim 8 wherein said cushion member is formed from a plurality of laterally hinged panels folded into a stack of juxtaposed panels.

11. An end cap in accordance with claim 8 wherein said portion of said inner wall defining said hollow vertical support member includes a plurality of laterally hinged panels folded in angularly disposed relation to a rectangular cross-sectional form.

12. An end cap in accordance with claim 8 wherein said outer end wall of said end cap includes two spaced apart, substantially parallel slots and said inner end wall includes a pair of integrally formed locking tabs that project in the direction of the outer wall when the inner wall is formed and folded against the inner surface of the outer wall and extend through said slots and lock the folded inner wall in position inwardly adjacent the outer wall.

13. A package comprising: a bathtub; a pair of end caps disposed in surrounding relation to the end portions of said bathtub, each said end cap being unitary and formed from a single precut sheet and including a generally planar outer end wall, a cushion member hingedly attached along the lower edge of said outer end wall and extending inwardly and generally normal thereto, a ledge hingedly attached along the upper edge of said outer end wall and extending inwardly and generally normal thereto, said ledge serving as a support surface for stacking similar packages, and an inner end wall hingedly attached along its upper edge to said ledge and disposed generally adjacent the inner surface of said outer end wall, said inner wall including a portion spaced inwardly from said outer wall and wing portions on either side thereof located immediately adjacent said outer wall, said spaced portion defining a hollow vertical support member and extending generally between said cushion and said ledge and providing support therebetween for said bathtub and the ends of said package, said wing portions extending generally between the underside of said ledge and the lower edge of said outer wall and providing additional end wall thickness and additional vertical support for the ends of said package; and an outer wrapper of foldable material extending around said bathtub and at least the peripheries of said end caps and secured to said end caps, completely enclosing said bathtub.

14. A package in accordance with claim 13 wherein said bathtub includes a depending front skirt on one of its longitudinal sides and wherein said outer end wall of said end cap includes a hingedly connected end panel having at its upper end a foldable flap and the flap in turn having a foldable tab, all of which are foldable down over the front skirt of the bathtub to hold the end cap in place during packaging of the bathtub.

15. A package in accordance with claim 13 wherein said cushion member is formed from a plurality of laterally hinged panels folded into a stack of juxtaposed panels.

16. A package in accordance with claim 13 wherein said single precut sheet forming said end cap is made of corrugated double wall fiberboard material with the flutes of the fiberboard running vertically in all vertical surfaces of the formed end cap.

17. A package in accordance with claim 13 wherein said portion of said inner wall defining said hollow vertical support member includes a plurality of laterally hinged panels folded in angularly disposed relation to a rectangular cross-sectional form.

18. A package in accordance with claim 13 wherein said outer end wall of said end cap includes two spaced apart, substantially parallel slots and said inner end wall includes a pair of integrally formed locking tabs that project in the direction of the outer wall when the inner wall is formed and folded against the inner surface of the outer wall and extend through said slots and lock the folded inner wall in position inwardly adjacent the outer wall.

* * * * *